US007540952B2

(12) United States Patent
Pinho et al.

(10) Patent No.: US 7,540,952 B2
(45) Date of Patent: Jun. 2, 2009

(54) CATALYTIC CRACKING PROCESS FOR THE PRODUCTION OF DIESEL FROM VEGETABLE OILS

(75) Inventors: Andrea De Rezende Pinho, Rio de Janeiro (BR); Mauro Silva, Rio de Janeiro (BR); Amilcar Pereira Da Silva Neto, Rio de Janeiro (BR); Júlio Amilcar Ramos Cabral, Rio de Janeiro (BR)

(73) Assignee: Petroleo Brasileiro S.A. - Petrobras, Rio De Janeiro (BR)

( * ) Notice: Subject to any disclaimer, the term of this patent is extended or adjusted under 35 U.S.C. 154(b) by 0 days.

(21) Appl. No.: 11/472,553

(22) Filed: Jun. 22, 2006

(65) Prior Publication Data

US 2007/0007176 A1 Jan. 11, 2007

(30) Foreign Application Priority Data

Jul. 7, 2005 (BR) ..... 0502577

(51) Int. Cl.
*C10G 47/24* (2006.01)
*C10G 47/02* (2006.01)

(52) U.S. Cl. ..... 208/108; 208/78; 208/113; 208/120.1; 208/155; 208/240; 585/13; 585/14; 585/240; 585/250

(58) Field of Classification Search ..... 208/108, 208/113, 120.1, 78, 155, 240; 585/240, 13, 585/14, 250
See application file for complete search history.

(56) References Cited

U.S. PATENT DOCUMENTS 4,164,506 A 8/1979 Kawahara et al.
4,390,416 A * 6/1983 Ritter et al. ..... 208/120.25
4,608,202 A 8/1986 Lepper et al.
4,695,411 A 9/1987 Stern et al.
4,698,186 A 10/1987 Jeromin et al.
4,992,605 A * 2/1991 Craig et al. ..... 585/240
5,009,769 A * 4/1991 Goelzer ..... 208/113
5,525,126 A 6/1996 Basu et al.
2005/0113588 A1 5/2005 Hillion et al.

FOREIGN PATENT DOCUMENTS

| | | |
|---|---|---|
| BR | PI 8304794 | 9/1983 |
| EP | 00127104 | 12/1984 |
| WO | WO 03/093400 | 11/2003 |

* cited by examiner

*Primary Examiner*—Glenn Caldarola
*Assistant Examiner*—Prem C. Singh
(74) *Attorney, Agent, or Firm*—Nixon & Vanderhye P.C.

(57) ABSTRACT

The present invention relates to a thermo catalytic process to produce diesel oil from vegetable oils, in refineries which have two or more Catalytic Cracking (FCC) reactors. At least one reactor processes heavy petroleum or residue in conventional operation conditions while at least one reactor processes vegetable oils in proper operation conditions to produce diesel oil. This process employs the same catalyst employed in the FCC process, which processes conventional feedstocks simultaneously. This process transforms high heat content raw materials into fuel hydrocarbons. It may improve efficiency for the obtainment of highly pure products and may not yield glycerin, one by-product of the transesterification process. The diesel oil produced by said process may have superior qualities and/or a cetane number higher than 40. Once cracking conditions occur at lower temperatures, it may form a less oxidized product, which is consequently purer than those obtained by existent technology.

5 Claims, 1 Drawing Sheet

CATALYTIC CRACKING PROCESS FOR THE PRODUCTION OF DIESEL FROM VEGETABLE OILS

BACKGROUND OF THE INVENTION

1. Field of the Invention

This invention is concerned with a fluid catalytic cracking process (FCC) for the production of diesel oil from vegetable oils. More specifically, the invention refers to the production of diesel oil in refineries which have two or more FCC reactors. At least one reactor processes conventional feedstocks (petroleum or residue), while another one, simultaneously, processes vegetable oils in operational conditions proper to produce a diesel oil better quality, that is, with cetane number higher than 40 and sulfur free.

2. Description of the Prior Art

Since the middle of the last century, a large number of researches seek alternative technologies to produce fuel from renewable sources or industrial wasting. The transesterification reaction or alcoholisis appeared as a novel procedure, significantly advantageous, to allow the obtention of fuels from triglycerides which are present, for instance, in vegetable oils. References regarding this subject can be found in the European publication EP 00127104. One employs methanol, or alternatively ethanol, to yield long chain esters and glycerin, as it shows the chemical equation below:

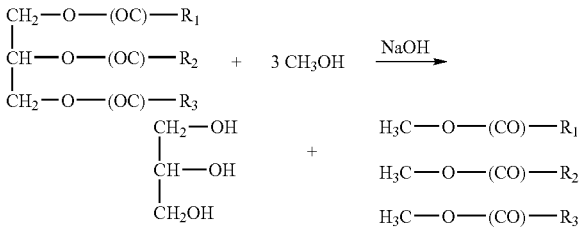

The U.S. Pat. No. 4,695,411 describes a procedure in which the main target is to provide a profitable process employing hydrated alcohol to obtain highly pure esters mixture. The process is applicable to either animal or vegetable oils, including seeds oils.

Similarly, the U.S. Pat. No. 4,164,506 and the U.S. Pat. No. 4,698,186 describe processes in which one use acidic catalysts to esterify triglycerides in two stages.

The non-alcaline catalysts, as described in the U.S. Pat. No. 5,525,126, show an additional advantage since they do not catalyze the formation of soap and, therefore, they do not allow the triglycerides pre-esterification.

In the U.S. Patent Application No. 2005/0113588A1, a fuel preparation method, from several oils or combinations among them, employs two reactors and one heterogeneous catalyst in order to accomplish the alcoholisis. The catalyst is made up of a mixture of zinc and aluminum oxides.

In the publication WO 03/093400, one employs phosphorous compounds as polymerization inhibitors and iron or copper compounds as reduction agents, in order to adjust oxidative cracking reactions with ozone. After successive filtering and cracking steps, one obtains a lighter compounds fraction which exhibit excellent properties for diesel oil use.

The transesterification with methanol or ethanol, however, presents somewhat constraints. The necessity to transport and to handle large amounts of such inputs requires excessively high investment for the assembling and maintaining safe plants, mainly due to the its effective risk of intoxication and fire. Moreover, the burning of fuel produced from glyceride alcoholic transesterification generates a considerable amount of formaldehyde, acrolein and benzene, which besides pollutants they cause damages to pistons and engines.

The state-of-art shows that in studies cited in the technical literature about vegetable oils processing in fluid catalytic cracking units (UFCCs), the vegetable oil is always mixed to the conventional feedstocks. The literature does not mention studies focused on the diesel production directly from vegetable oil. (BUCHSBAUM, A.; HUTTER, K.; DANZINGER, F; LICHTSCHEIDL, J. The Challenge of the Biofuels Directive for a European Refinery, ERTC 9th Annual Meeting, Praga, 2004).

The Brazilian Patent No. PI 8304794, approaches the high octane gasoline production. One introduces the vegetable oil and the conventional FCC feedstock (petroleum) together in the FCC reactor. The gasoline produced is of excellent quality, because it is highly aromatic and sulfur free.

In the UFCCs, the difficulty of producing good quality diesel oil, from the mixture of vegetable oil and conventional feedstock, is due to the very high reaction temperatures, never lower than 490° C. Moreover, the vegetable oil volume available for diesel oil production is too much small compared to the petroleum volume processed nowadays. Compared to the transesterification process, investment costs used to be too high that they do the assembling of an UFCC unfeasible for processing exclusively vegetable oil. Hence, one could introduce this alternative route, for diesel production at the refinery's UFCC, where two reactors already exist.

Although the processing at temperatures above 490° C. brings about the drop of fuel oil formation, which is of little value-added, it favors a large number of hydrogen transfer reactions. Thereby, it yields an expressive amount of aromatic compounds, in spite of such compounds are absent in the vegetable oil of the feedstock. However, the diesel oil produced at high temperatures is not of good quality, inasmuch as its cetane number is low. Low temperatures do not vaporize the feedstock utterly in the FCC reactor. When the feedstock is not vaporized utterly just in the reactor feeding inlet, the catalytic selectivity drops, because the catalyst pores get blocked. Thereby, most of the reactions takes place on the particles surface, seeing that in liquid phase the feedstock do not diffuse toward the catalyst's micropores and do not reach the core active sites.

SUMMARY OF THE INVENTION

In general, a refinery's UFCC has only one reactor for the catalytic cracking of petroleum or residue. Nevertheless, there are refinery's UFCCs which have two reactors working simultaneously. There, one mix the waste catalyst streams from both reactors in the same rectification section, where only one regenerator accomplishes the catalyst coke burn. Besides, the reactors might work independently, respectively with different feedstock types and distinct reaction temperatures. The reaction severity applied to each reactor might be totally distinct, allowing their adjustment to pre-established operational objectives. Then, one can conduct the vegetable oil processing with milder conditions, between 250° C. and 490° C., in order to produce diesel oil with cetane number higher than 40, while one conduct at the same time the processing of heavy petroleum or conventional residues with more severe conditions, employing one only catalyst stream to both.

DETAILED DESCRIPTION OF THE PREFERRED MODES

Figure 1:
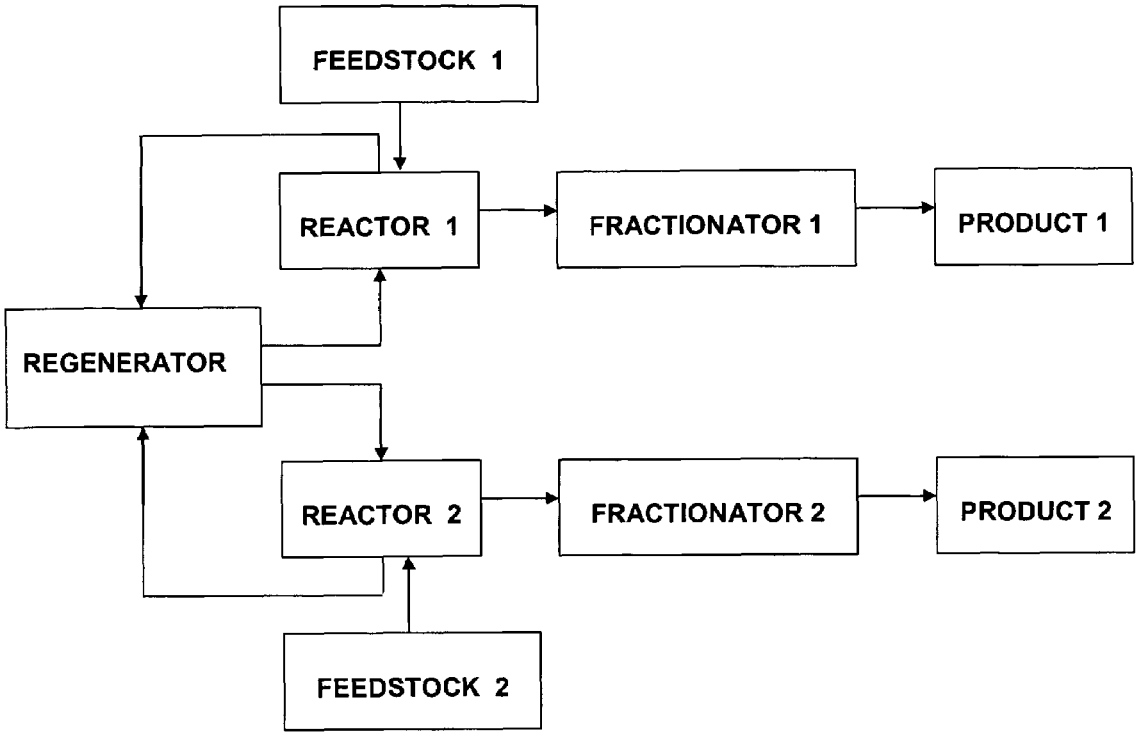
FIG. 1 displays the diagram of an FCCU working with two reactors operating with one catalyst stream. The feedstocks 1 and 2, which feed the reactors, can be of the same type or different. They can be ascendant type (riser) or descendant type (downflow).

The present invention relates a thermo catalytic process for the production of diesel oil from vegetable oils, in refineries which have at least two FCC reactors. At least one reactor processes heavy petroleum or residue in conventional conditions, that is, at high reaction temperatures, between 490° C. and 650° C., contact time between the feedstock and the catalyst 2 to 8 seconds and ratio catalyst/oil between 4 and 10. At least one reactor processes vegetable oils in proper conditions to produce diesel oil, that is, low reaction temperatures, between 250° C. and 490° C., preferably between 350° C. and 400° C., contact time between the feedstock and the catalyst 0.5 to 2 seconds and ratio catalyst/oil between 1 and 4.

A typical catalyst is composed of 10-60% w/w of an acidic solid, 0-50% w/w of an alumina, 0-40% w/w of silica and the rest kaolin. The acidic solid can be a ZSM type zeolite, a faujasite type zeolite, a mordenite type zeolite, a silica-alumino phosphate (SAPO) or an alumino-phosphate (ALPO). The same catalyst, fresh or equilibrium, is employed, simultaneously, in both FCC reactor. FIG. 1 displays an operation diagram of a FCCU processing, respectively, petroleum and vegetable oil (Feedstock 1 and Feedstock 2) in two distinct FCC reactors (Reactor 1 and Reactor 2) and fed, simultaneously, with the same catalyst. The catalyst follows to the regenerator, while the products are fractionated (Fractionator 1 and Fractionator 2) and can be mixed afterwards in order to maximize anyone else fraction. The said process employs typical FCC reactors, which can be downflow type as well as upflow type. The contact time between the feedstock and the catalyst inside the reactor must be 0.5 to 2 seconds, preferably 1 to 1.5 second.

The said process transforms oil from any vegetable into fuel hydrocarbons and also presents excellent efficiency for obtaining high purity products. More specifically, the said process transforms the castor oil, the soybean oil, the cotton oil, the peanut oil or any other oil from any other vegetable, pure or wasted, into hydrocarbons within the diesel oil range and do not yield glycerin, the by product of the transesterification process.

One can observe in the example below that the performance of said process to achieve high quality diesel oil, sulfur free and with high cetane number, is due to the formation of aromatic compounds by cracking reactions which are favored at low temperatures. In addition, as the product is less oxidized, it is purer than those obtained by conventional technology.

EXAMPLE

The radicals R1, R2 e R3 in the triglyceride formula below (castor oil) are linear side chains (with no aromatic rings attached to), which contain a hydroxyl in the twelfth carbon atom and a double bond in the ninth.

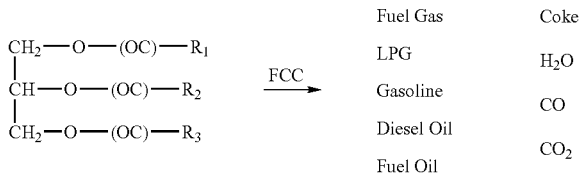

One evaluated the castor oil cracking in pilot scale. One chose an equilibrium catalyst with reduced rare earth content in order to avoid hydrogen transfer reactions during the experiments. One changed the catalyst to oil ratio by varying the reaction temperature from 300° C. up to 400° C. One held the rectifier at 500° C. while one operated the separation tank at the same temperature of the riser. One accomplished a previous evaluation as reference by operating the unit without vapor, being nitrogen used in the dispersion and rectification. Therefore, one ascribed the yielded water of the oil stream as been utterly derived from the castor oil. In order to correct mass balances one used the mean value obtained, 11%, discounting the yielded water from the oil. In order to analyze the effluents one used simulated distillation, ASTM D 2887. One determined the gasoline and diesel fractions by the cut point, from 170° C. to 380° C. In order to estimate the diesel cut quality one used gas chromatography coupled to mass spectrometry (GC/MS), liquid chromatography and cetane number analysis (CN).

The product yields profile, obtained from the water mass balance, did not vary with the reaction temperature range (300° C. to 400° C.) in spite of the higher the vapor flow the higher the dispersion. The vegetable oil was completely converted, as it shows the yields profile in Table 1. It was not noticed the presence of esters in the liquid effluent.

One did not measure the cetane number in the reference sample due to its instability. The quality of the diesel oil produced from castor oil processing in mild operation conditions (CN=40.7) is quite superior compared to the quality of the diesel oil produced from petroleum processing in conventional operation conditions (CN<19), allowing it can be blended in order to maximize the product.

The processing of castor oil for diesel production from FCC process is absolutely feasible since one conducts proper reaction temperatures, near 400° C. The diesel oil yield was too much higher (68.9%) when processing pure castor oil instead of mixed up to petroleum (14.8%). The variation of the yields as well as of the quality of the liquid effluents were negligible when it was employed a wider temperature range, between 300° C. and 400° C., a feed flow 50% higher or a riser vapor flow increased 10 fold. The vegetable oil was utterly consumed and it was not detected the presence of esters in the liquid effluent.

TABLE 1

| Target | Gasoline Maximization | Diesel Oil Maximization |
|---|---|---|
| Feedstock | Petroleum + Castor Oil | Castor Oil |
| Condition | FCC severe | FCC mild |
| Reaction Temperature | 600° C. | 400° C. |
| Fuel Gas | 5.8% | 1.0% |
| LPG | 24.1% | 3.5% |
| Gasoline | 37.7% | 11.6% |
| Diesel Oil | 14.8% | 68.9% |
| Heavy Oil | 3.7% | 0% |

TABLE 1-continued

| Target | Gasoline Maximization | Diesel Oil Maximization |
|---|---|---|
| Coke | 6.0% | 4.0% |
| Water | 7.9% | 11% |
| Total | 100% | 100% |

The invention claimed is:

1. A thermo-catalytic process using at least two fluid catalytic cracking unit reactors, the method comprising the steps of:

supplying a petroleum feedstock to a first fluid catalytic cracking reactor;

supplying a vegetable oil feedstock to a second fluid catalytic cracking reactor;

supplying a catalyst to the first catalytic cracking reactor and to the second catalytic cracking reactor;

contacting the petroleum feedstock with the catalyst inside the first fluid catalytic cracking reactor so as to facilitate a catalytic cracking reaction;

catalytically cracking the petroleum feedstock and producing a first effluent stream comprising a reaction product;

separating the reaction product in the first effluent stream;

contacting the vegetable oil feedstock with the catalyst inside the second fluid catalytic cracking reactor so as to facilitate a catalytic cracking reaction;

catalytically cracking the vegetable oil feedstock and producing a second effluent stream comprising a reaction product;

separating the reaction product in the second effluent stream; and regenerating the catalyst in a regenerator from the first and second fluid catalytic cracking reactors such that the catalyst may be recycled to the first and second catalytic cracking reactors as a regenerated catalyst.

2. The process of claim 1 wherein said vegetable oil is castor oil, soybean oil, cotton oil, peanut oil or any other oil from vegetable source, pure or wasted.

3. The process of claim 1 wherein said catalyst comprises 10-60% w/w of solid acid, 0-50% w/w of alumina, 0-40% w/w of silica and the rest kaolin.

4. The process of claim 3 wherein said solid acid is a ZSM type zeolite, a faujasite type zeolite, a mordenite type zeolite, a silica-alumina phosphate (SAPO), an alumina-phosphate (ALPO), or any combination among them.

5. The process of claim 1 further comprising the steps of:

simultaneously recycling the regenerated catalyst to the first and second fluid catalytic cracking reactors; and operating the first fluid catalytic cracking reactor in severe conditions in order to process petroleum at a reaction temperature between 490° C. and 650° C., with a contact time between 2 and 8 seconds, and with a catalyst to petroleum ratio between 4 and 6; and operating the second fluid catalytic cracking reactor in mild conditions in order to process a vegetable oil at a reaction temperature between 250° C. and 490° C., with a contact time between 0.5 and 2 seconds; and with a catalyst to vegetable oil ratio between 1 and 4.

* * * * *